United States Patent [19]

Abraham et al.

[11] 4,180,725

[45] Dec. 25, 1979

[54] GATING APPARATUS FOR STATIC CROSSED FIELD PHOTOMULTIPLIERS

[75] Inventors: Wayne G. Abraham, Los Altos Hills; Richard S. Enck, Jr., San Jose, both of Calif.; Ronald H. Goehner, Wayne, N.J.; Robert V. Brick, Sunnyvale, Calif.

[73] Assignee: The United States of America as represented by the Secretary of the Air Force, Washington, D.C.

[21] Appl. No.: 904,965

[22] Filed: May 11, 1978

[51] Int. Cl.² ..... H01J 39/12

[52] U.S. Cl. ..... 250/207; 250/213 VT; 313/95

[58] Field of Search ..... 250/207, 213 VT; 313/95, 105 R

[56] References Cited

U.S. PATENT DOCUMENTS 3,431,420 3/1969 Fisher ..... 250/207

*Primary Examiner*—David C. Nelms
*Assistant Examiner*—Darwin R. Hostetter
*Attorney, Agent, or Firm*—Joseph E. Rusz; Sherman H. Goldman

[57] ABSTRACT

Gating apparatus for a static crossed field photomultiplier utilizes a gating electrode which is mounted in a position between the cathode and the rail electrode. The gating electrode is pulsed thus causing the cathode current to be either multiplied or diverted so as to modulate the current by shifting the cathode beam into and out of the dynode area where secondary amplification occurs.

4 Claims, 1 Drawing Figure

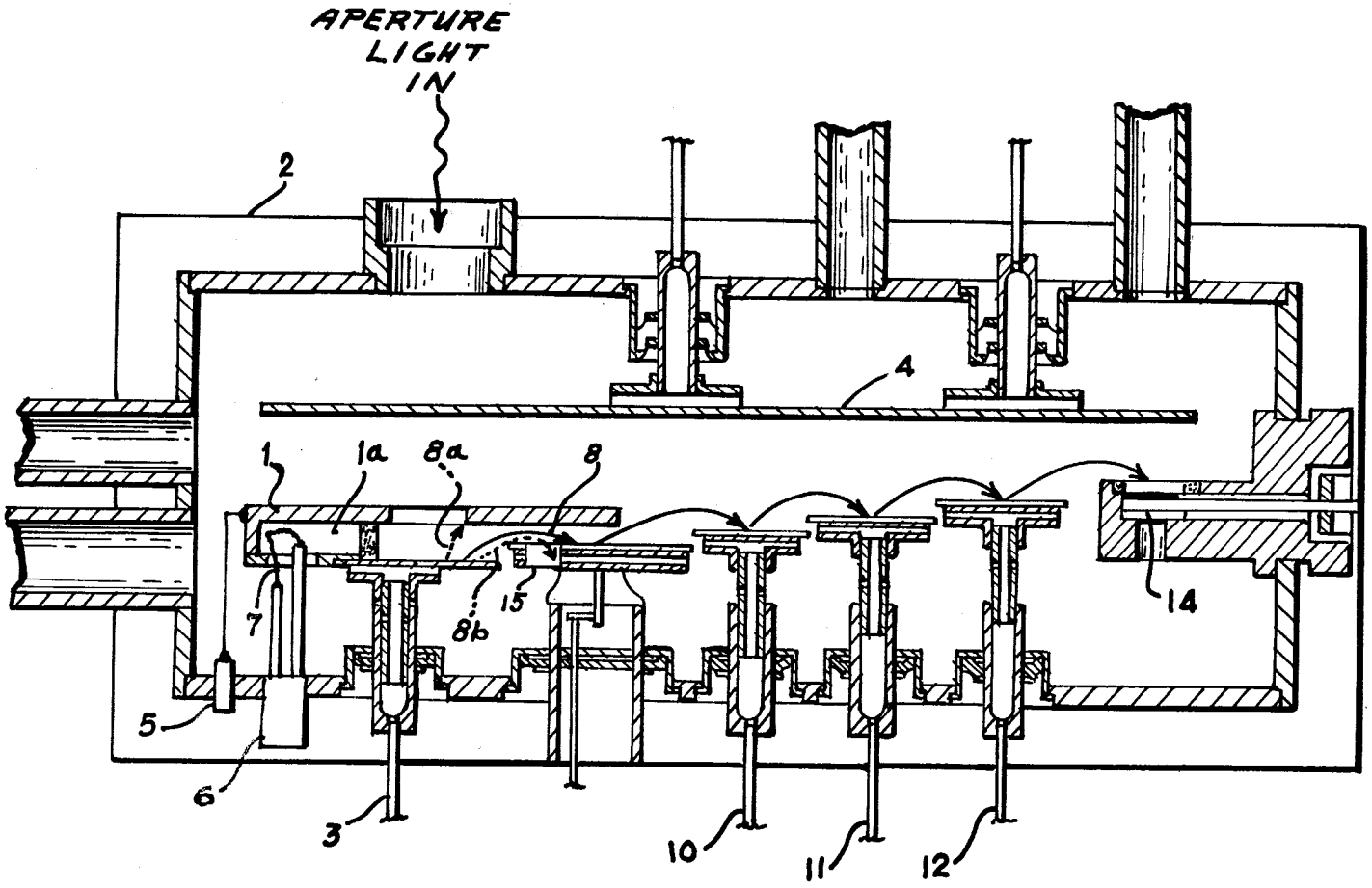
APERTURE LIGHT IN
2
1
1a
8a
8b
8
15
7
5
6
3
4
10
11
12
14

GATING APPARATUS FOR STATIC CROSSED FIELD PHOTOMULTIPLIERS

STATEMENT OF GOVERNMENT INTEREST

The invention described herein may be manufactured and used by or for the Government for governmental purposes without the payment of any royalty thereon.

BACKGROUND OF THE INVENTION

In the prior art there are a multiplicity of techniques and devices for modulating light, particularly light emanating from a laser. In some of the light modulating techniques and devices there are utilized photomultipliers. In the present invention a static crossed field photomultiplier is employed by using a gating electrode which is mounted in a position between the cathode and the rail electrode. The electrode is pulsed with a sinusoidal RF drive for the purpose of causing the cathode current to be either multiplied or diverted so as to cut off the flow of collector current. This permits the modulation of the current by shifting the cathode beam into and out of the dynode area where secondary amplification occurs.

SUMMARY OF THE INVENTION

A gating apparatus for a static crossed field photomultiplier is provided to periodically gate at RF frequency the cathode current thereof. There is incorporated a gating electrode within the static crossed field structure. An RF sinusoidal voltage is coupled to this electrode. Its peak-to-peak voltage variation is utilized to positionally shift the cathode beam current into and out of the dynode area where secondary amplification can occur.

DESCRIPTION OF THE DRAWINGS

The single FIGURE of the preferred embodiment shows schematically gated static crossed field photomultipliers.

DETAILED DESCRIPTION OF THE PREFERRED EMBODIMENT

Now referring in detail to FIG. 1, there is shown gating electrode 1 incorporated within the structure of static crossed field photomultiplier 2. It is noted that static crossed field photomultiplier 2 is conventional and may be of the type manufactured by Varian Associates. The invention comprises gating electrode 1 spaced between cathode 3 and rail electrode 4. Gating electrode 1 is placed along a constant voltage field line in the device. DC bias is applied to gating electrode 1 by way of input 5. RF drive for gating electrode 1 is supplied via RF gating drive input 6 and loop coupler 7. With no RF gating drive input it would be biased such that it has no electrical effect on cathode current 8. Under this condition the static crossed field photomultiplier operates as if gating electrode 1 did not exist and cathode current 8 is amplified by four successive dynodes 9, 10, 11 and 12, and registered at collector 14. When an RF voltage is induced on gating electrode 1 (which is part of resonant cavity 1*a*) cathode beam path 8 can be altered to flow along either path 8*a* or 8*b* during certain portions of the RF voltage cycle. Path 8*a* causes cathode current to strike gating electrode 1 during the positive portion of the Rf cycle. The flow to dynode 9 is thereby stopped and the collector current is cut off. Path 8*b* forces cathode current through hole 15 in dynode 9 during the negative portion of the RF cycle thus missing the active dynode surface, again resulting in a cut-off of signal at collector 14. Another hole could be placed on the right side of dynode 9 and the cathode current could be swept from one hole to the other hole, thereby gating the cathode current off twice during one RF cycle allowing for example, 1 GHz gating with a 500 MHz RF drive.

We claim:

1. In a static crossed field photomultiplier, apparatus for periodically gating at RF frequency the cathode current therein comprising a cathode, an output collector spaced from said cathode, a series of dynodes arranged between said cathode and said output collector, the first of said dynodes positioned on one side of said cathode, said first dynode having a hole therethrough, a gating electrode placed along a constant voltage field line in said crossed static field photomultiplier and also positioned on the other side of said cathode, and Rf drive means for said gating electrode operating so that without RF gating drive input the cathode current is unaffected and said series of dynodes amplifies said cathode current and upon introduction of said RF gating drive input the cathode current alternately flows through said hole in said first dynode to cut off the collector output and then strikes said first dynode for amplification in the remaining dynodes and to provide a collector output.

2. In a static crossed field photomultiplier, apparatus for periodically gating at RF frequency the cathode current therein as described in claim 1 further including a rail positioned opposite to said series of dynodes with said gating electrode spaced between said rail and said cathode.

3. In a static crossed field photomultiplier, apparatus for periodically gating at RF frequency the cathode current therein as described in claim 2 wherein said gating electrode is comprised of resonant cavity.

4. In a static crossed field photomultiplier, apparatus for periodically gating at RF frequency the cathode current therein as described in claim 3 wherein said RF drive means is comprised of a loop coupler positioned in said resonant cavity and RF drive input to said loop coupler.

* * * * *